United States Patent [19]

Iwasaki

[11] Patent Number: 4,496,142

[45] Date of Patent: Jan. 29, 1985

[54] SHEET SUPPLYING DEVICE FOR TWO-SIDED COPYING

[75] Inventor: Yasuo Iwasaki, Kanagawa, Japan

[73] Assignee: Fuji Xerox Co., Ltd., Tokyo, Japan

[21] Appl. No.: 487,661

[22] Filed: Apr. 22, 1983

[30] Foreign Application Priority Data

Apr. 22, 1982 [JP] Japan ..... 57-66219
Aug. 28, 1982 [JP] Japan ..... 57-148501

[51] Int. Cl.[3] ..... B65H 5/22
[52] U.S. Cl. ..... 271/3; 271/186; 271/301; 271/902; 355/14 SH; 355/24; 242/59
[58] Field of Search ..... 271/3, 3.1, 301, 186, 271/DIG. 9; 242/59; 355/14 SH, 24

[56] References Cited

U.S. PATENT DOCUMENTS 3,908,978 9/1975 Stemmle ..... 271/3 X
4,059,259 11/1977 Cosmo ..... 271/3
4,176,945 12/1979 Holzhauser ..... 271/186 X

*Primary Examiner*—Richard A. Schacher
*Attorney, Agent, or Firm*—Sughrue, Mion, Zinn, Macpeak, and Seas

[57] ABSTRACT

A copier or similar device is provided with an apparatus for storing and reversing or turning over a plurality of sheets used for two-sided copying. The sheets are stored between adjacent windings of a film or belt member after copying on one side thereof, after which the belt member is reversed to feed sheets one by one to the copying station such that the unprinted side of the sheets may be recorded upon.

16 Claims, 7 Drawing Figures

SHEET SUPPLYING DEVICE FOR TWO-SIDED COPYING

BACKGROUND OF THE INVENTION

This invention relates to a device for successively supplying both the front and rear sides of a sheet to an apparatus such as a copying machine or facsimile in a switching mode so that the apparatus may record on both sides of the sheet.

In a conventional device of this type, sheets which have copied an original on the first side thereof are stacked in a one-side-copied sheet tray one after another, and the sheets thus stacked are delivered out of the tray and are turned over by a reversing mechanism before they reach the copying machine, so that originals are recorded on both sides of each sheet.

In the conventional device, the sheets having an original copied on one side are stacked in the sheet tray one after another as described above. Therefore, it is difficult to successively stack the sheets in the tray, which may be different in paper quality or size according to different copying operations. Even if these sheets are correctly placed in the tray, it is difficult to deliver the sheets out of the tray one after another; sometimes two or more sheets are delivered in a stacked state.

In the case where curled sheets are put in the one-side-copied sheet tray, it is difficult to uniformly stack the sheets.

The conventional device further requires a mechanism for delivering sheets from the one-side-copied sheet tray. Therefore, the conventional device is intricate in construction and high in manufacturing cost.

SUMMARY OF THE INVENTION

Accordingly, an object of this invention is to eliminate the above-described difficulties accompanying the conventional supply device for two-sided copying. More specifically, an object of the invention is to provide a device for successively supplying the two sides of a sheet to an apparatus such as a copying machine, in which sheets, the first sides of which have been subjected to recording, are held between the layers formed by winding a belt, so that the sheets are positively reversed, i.e., turned over, before reaching the apparatus.

DETAILED DESCRIPTION OF THE PREFERRED EMBODIMENTS

Figure 1:
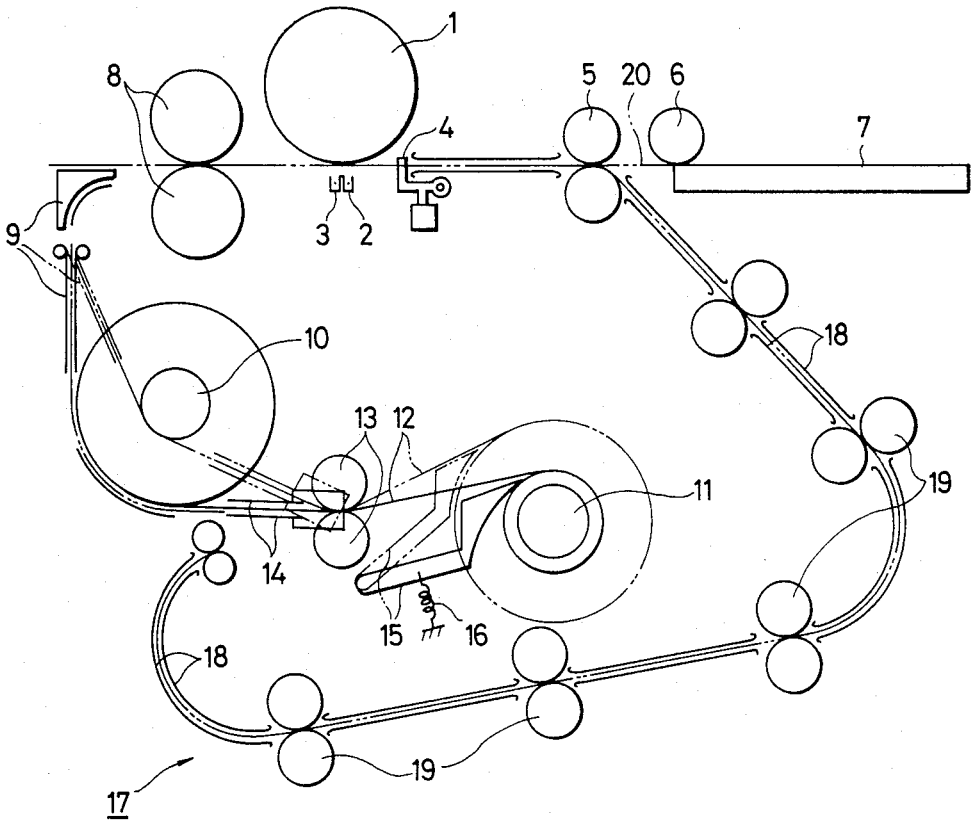
FIG. 1 is a side view describing the operation of a device according to this invention in which a picture is recorded on only one side of a sheet.
Figure 2:
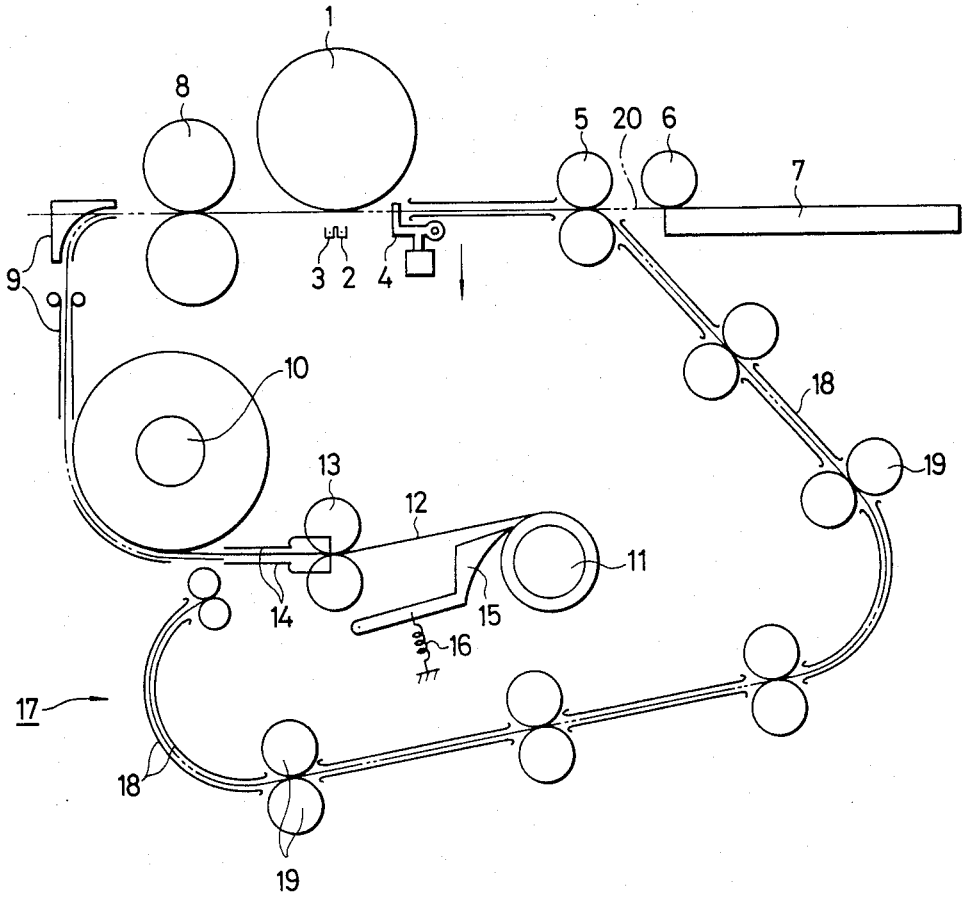
FIG. 2 is a side view describing the operation of recording a picture on one side of a sheet, in a two-sided copying operation.
Figure 3:
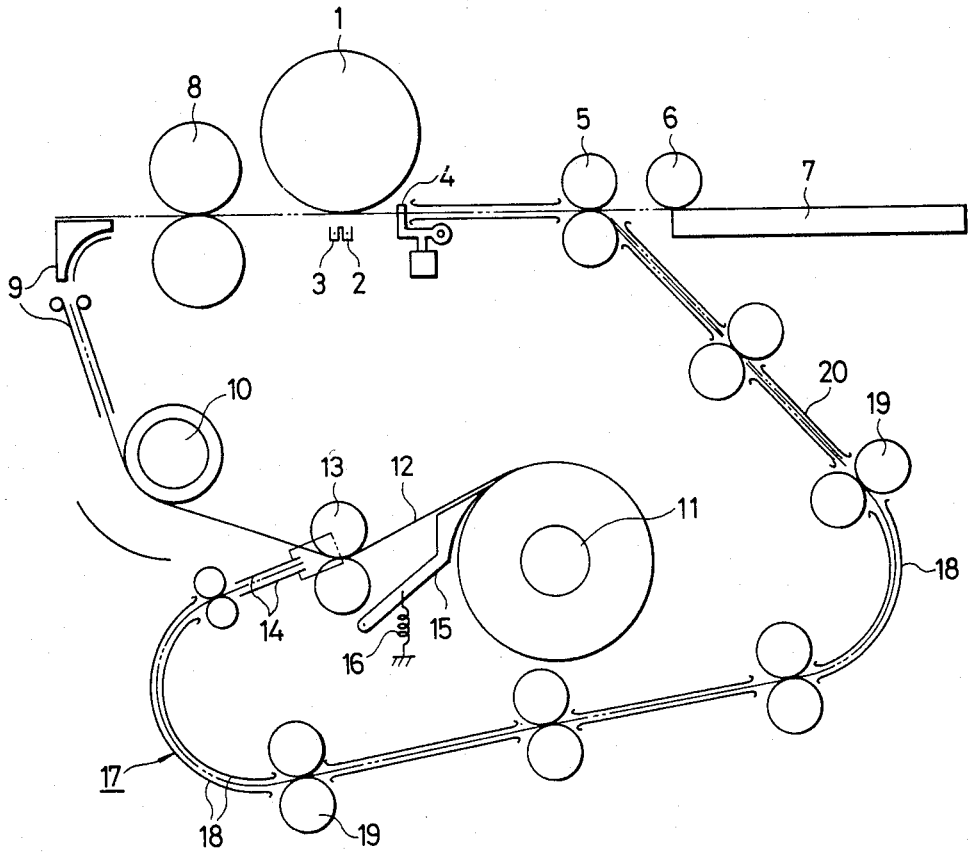
FIG. 3 is a side view describing the operation of recording a picture on the reverse side of sheets already recorded on the front sides thereof.

One example of the sheet supplying device, as applied to an electrographic copying machine, will now be described with reference to the accompanying drawings.

In these figures, reference numeral 1 designates a drum-shaped photosensitive unit of the electrographic copying machine. The unit 1 is rotated clockwise. The surface of the unit 1 is charged by a charger (not shown), and the image of an original is optically formed on the surface of the unit 1 thus charged, so that its latent image is formed thereon. The latent image thus formed is developed by a developing unit (not shown).

A transfer corotron 2 and a detaching corotron 3 are disposed below the drum-shaped photosensitive unit 1, so that, as a sheet 20 is delivered at the same speed as the surface speed of the photosensitive unit 1, the toner image formed on the surface of the unit 1 is transferred onto the sheet 20, and then the sheet 20 is peeled off from the unit 1 by the detaching corotron 3.

A gate 4 is disposed on the sheet receiving side (the right-hand side in FIG. 1) of the photosensitive unit 1, and sheet supplying rolls 5, a sheet supplying pinch roll 6 and a sheet supply tray 7 are arranged upstream of the gate 4 in the stated order.

Fixing rolls 8 are provided on the sheet delivery side of the drum-shaped photosensitive unit 1, and a sheet delivery switching chute 9 is provided downstream of the fixing rolls 8.

Scrolls 10 and 11 are rotatably mounted below the drum-shaped photosensitive unit 1. A "Mylar" film 12 of synthetic resin is wound counterclockwise on the scroll 10 close to the switching chute 9, with one end of the film 12 connected to the scroll 10. The film 12 is further wound clockwise on the scroll 11, with the other end of the film 12 connected to the scroll 11.

A pair of pinch rolls 13 which are arranged vertically are disposed between the spools or scrolls 10 and 11. A pair of sheet reversing switching chutes 14 are arranged vertically and disposed between the pinch rolls 13 and the scroll 10, in a manner such that the chutes 14 are vertically swingable about their end near the pinch rolls 13. These elements provide a sheet winding belt and means for rewinding the belt.

A strip finger 15 is arranged between the pinch rolls 13 and the scroll 11 in a manner such that the end of the strip finger 15 is brought into contact with the "Mylar" film 12 on the scroll 11 via the elastic force of a tension spring.

Sheet reversing conveyance means 17 is provided between the position where the end of the switching chutes 14 is located when the latter are swung downwardly and the sheet supply rolls 5. The means 17 comprises guide chutes for guiding the sheets 20 and conveying rolls 19 for conveying the sheets 20.

The device of the invention is constructed as described above. In operation, in a one-sided copying operation in which an original is copied on the first side of the sheets, the copying machine is operated with the gate 4 and the sheet delivery switching chute 9 set downwardly. The sheets 20 in the sheet supply tray 7 are delivered one by one to the drum-shaped photosensitive unit 1 by rotation of the sheet supplying pinch roll 6 and the sheet supplying rolls 5. The toner image formed on the surface of the photosensitive unit 1 is transferred onto a sheet 20. The sheet 20 is then separated from the photosensitive unit 1. The toner image on the sheet is fixed by the fixing rolls 8. The sheet 20 thus treated is discharged, passing over the sheet delivery switching chute 9.

In a two-sided copying operation in which originals are copied on both sides of the sheets, after the gate 4 is moved downwardly and the chutes 9 and 14 are moved upwardly, the copying machine is operated and the scroll 11 is turned clockwise. In this operation, an original is copied on one side of the sheet similarly to the above-described case. Then, the sheet is guided downwardly by the sheet delivery switching chute 9 and passes through the sheet reversing switching chutes 14 together with the "Mylar" film 12 on the scroll 10. The sheet 20 is then held between that part of the film 12 which was priorly wound on the scroll 11 and that part of the film which is being wound on the scroll 11, while being pushed against the film 12 by the pinch rolls 13 and being drawn by the strip finger 15. Thus, the sheet 20 together with the "Mylar" film 12 is wound on the scroll 11.

When the original has been copied on the first side of the required number of sheets 20 in the above-described manner, the rotation of the scroll 11 is stopped. Then, with the gate 4 set upwardly, the chutes 9 and 14 set downwardly and the sheet supplying pinch roll 6 stopped, the scroll 10 is turned clockwise and the conveying rolls 19 are operated. As a result, each of the one-side-copied sheets wound on the scroll 11 is conveyed to the gate 4 along the guide chute 18 by the conveying rolls 19 while being reversed (turned over), and is detained at the gate 4. Therefore, by moving the gate 4 downwardly in synchronization with the operation of the copying machine, an original is recorded on the other side of the sheets. Thus, the two-sided copying operation is accomplished.

In the device of the invention, the one-side-copied sheets 20 are held by the "Mylar" film 12 wound on the scroll 11 one by one. Therefore, the device can positively reverse the sheets 20 and supply the sheets thus turned over to the copying machine.

A second example of a device according to the invention, will now be described with reference to FIGS. 4 through 7.

In these figures, reference numeral 21 designates a drum-shaped photosensitive unit in an electrographic copying machine. The photosensitive unit 21 is turned clockwise. The surface of the unit 21 is charged by a charger (not shown), and the image of an original is formed on the surface of the unit 21 by exposure means, so that a latent image is formed thereon. The latent image is developed by a developing unit (not shown). A transfer corotron 22 and a detaching corotron 23 are disposed below the drum-shaped photosensitive unit 21, so that, as a sheet 224 is delivered at the same speed as the surface speed of the photosensitive unit 21, the toner image on the surface of the unit 21 is transferred onto the sheet 224. The sheet 224 is then peeled off from the photosensitive unit 1 by the detaching corotron 23.

One end of a sheet supplying chute 25 having sheet supplying rolls 24 and conveying rolls 26 is connected to the sheet receiving side (the right-hand side in FIG. 4) of the photosensitive unit 21, and the other end is connected to a sheet supply tray 27, so that the sheets 224 stacked in the tray 27 are supplied to the photosensitive unit 1 one after another by a pinch roller 28 provided for the tray 27, the sheet supplying rolls 24 and the sheet conveying rolls 26.

On the other hand, a conveyor belt 29, fixing rolls 210 and a sheet delivery switching pawl 211 are arranged on the sheet delivery side of the photosensitive unit 21 in the stated order, so that the toner image fixed onto the sheet 224 is fixed by fixing rolls 210. The sheet thus treated is selectively delivered into a sheet discharge tray 212 or a sheet reversing chute 213 by the sheet delivery switching pawl 211.

Pairs of sheet turn-over rolls 214, which can be turned in either direction, are disposed in the sheet reversing chute 213 at certain intervals. A pair of belt clamping rolls 215 are arranged at the lower end of the chute 213.

Belt supporting rolls 216 and 217 are spaced by a predetermined distance from each other and are pivotally mounted. An endless belt 218 is laid over the rolls 216 and 217. One end of a belt 219 is fixedly connected to one point 218*a* on the endless belt 218. The belt 219 is wound through the endless belt 218 onto the belt supporting rolls 216 and 217, thus forming several belt layers thereon. The belt 219 thus wound passes through the belt clamping rolls 215 and is then wound, in the form of a scroll, on a shaft.

A chute 22 extends from the middle part of the sheet turn-over chute 213 to the middle part of the sheet supply chute. A course switching pawl 221 is provided at the branching point of the chutes 213 and 222. Conveying rolls 223 are inserted in the chute 222.

A separating pawl 225 is disposed adjacent to the belt clamping rolls 215 in a manner such that it is in contact with the surface of the belt 219 wound on the belt supporting roll 217. More specifically, the end of the pawl 225 is depressed against the surface of the belt 219 by the elastic force of a spring 226 coupled to the pawl 225, so that the sheets 224 are separated from the surface of the belt 219 by the separating pawl 225.

The belt supporting roll 217 is connected through slip clutches 227 and 228 and an electromagnetic clutch 229 to a motor 230. The shaft 220 is coupled through slip clutches 231 and 232 and an electromagnetic clutch 233 to the motor 230.

The pair of belt clamping rolls 215 are coupled to each other through gears 234. One of the rolls 215 is coupled to the motor 230 through an electromagnetic clutch 235. The slip clutches 227 and 231 operate to apply a load to the roll 217 when the belt 219 is rewound by the endless belt. The slip clutches 228 and 232 operate to absorb the peripheral speed variation caused when the belt 219 is wound or rewound.

Figure 4:
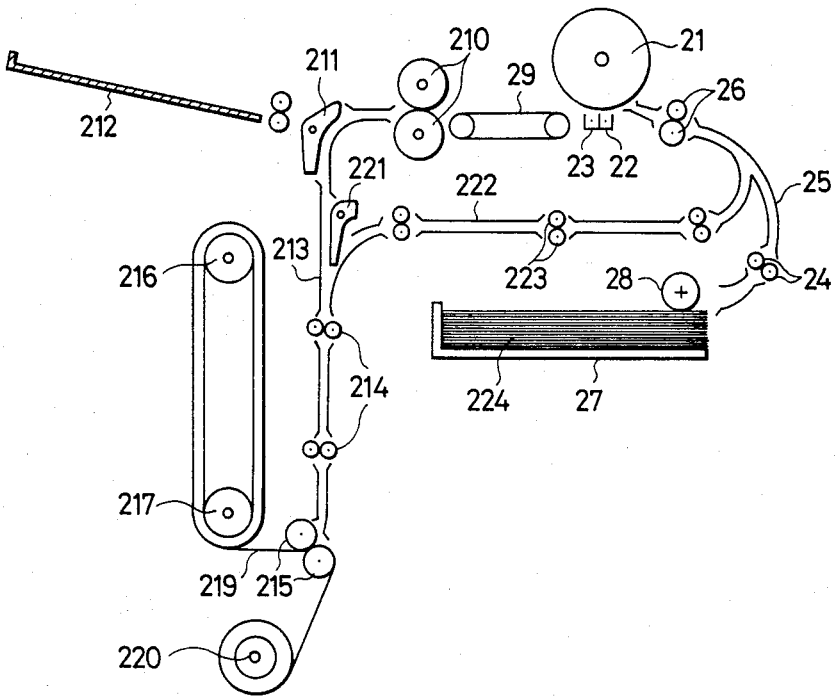
FIG. 4 is a side view outlining a second example of a device for two-sided recording according to this invention.
Figure 5:
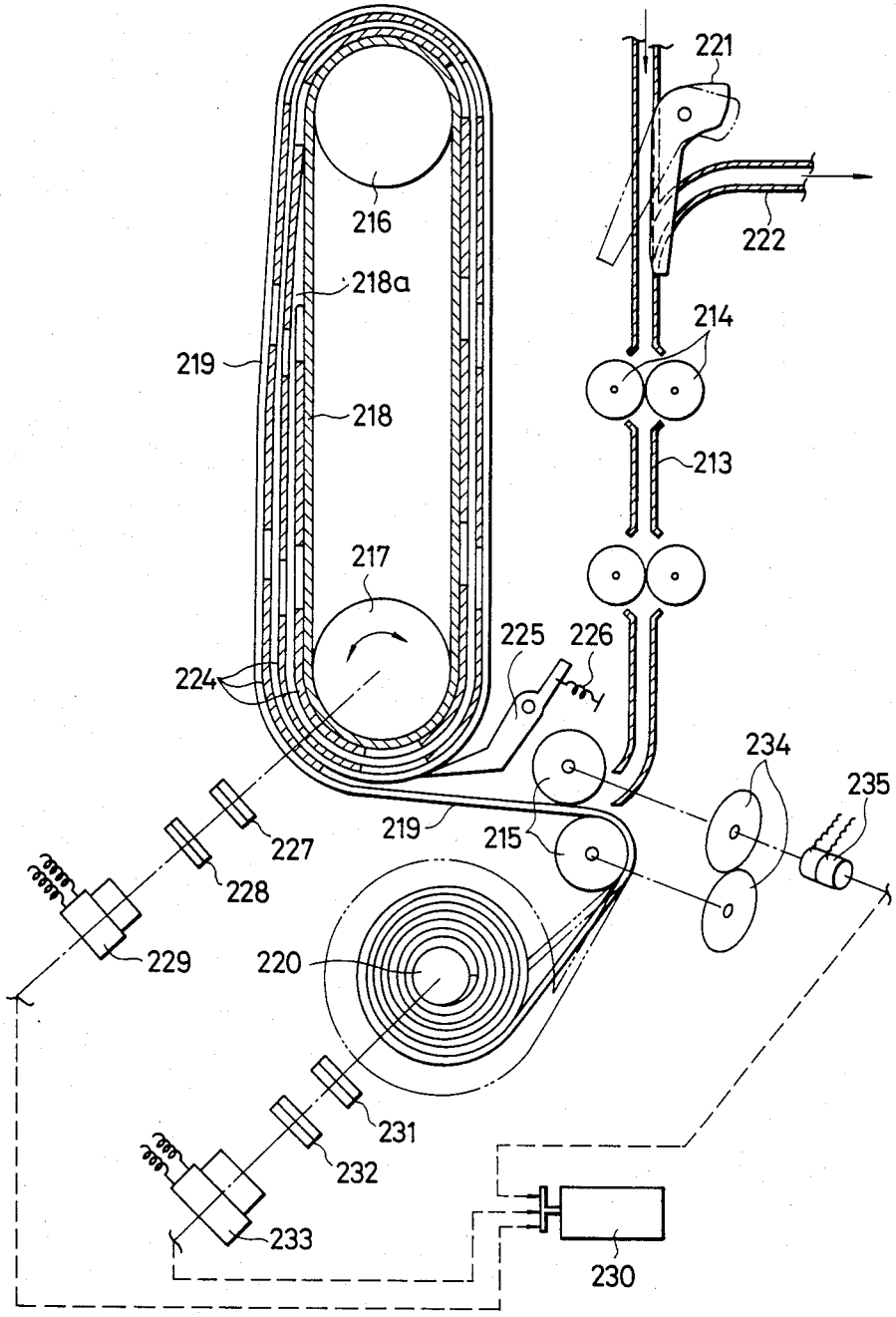
FIG. 5 is an enlarged side view showing the essential components of the device in FIG. 4.
Figure 6:
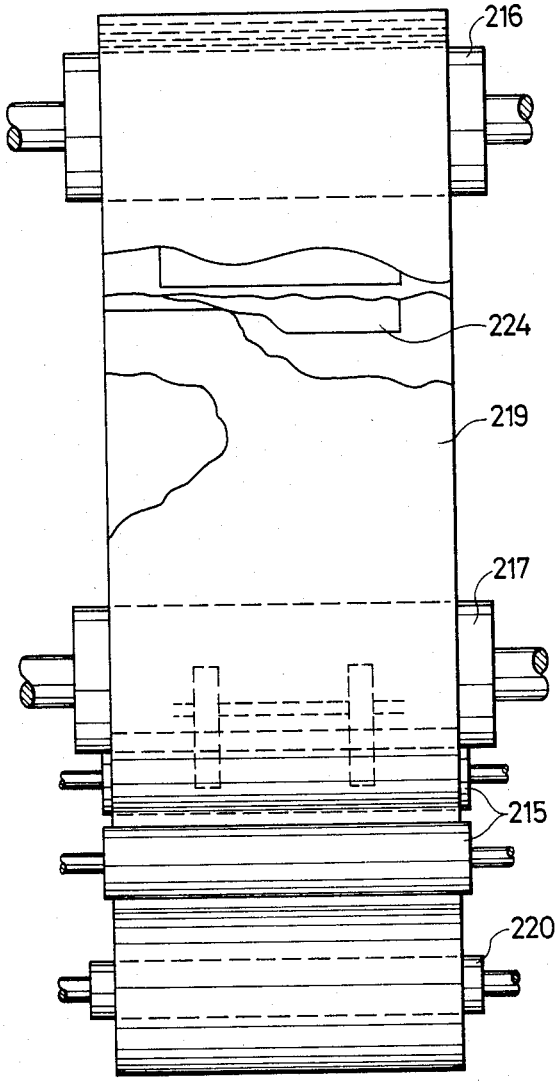
FIG. 6 is a front view, with parts cut away, of a part of the device of FIG. 4.

The device shown in FIGS. 4 through 6 is constructed as described above. Where an original is copied only on one side of a sheet 224, the drum-shaped photosensitive body 21, the sheet supplying rolls 24, the conveying rolls 26, the pinch roll 28, the conveying belt 29 and the fixing rolls 210 are driven. In this operation, the sheets 224 in the sheet supply tray 27 are delivered through the chutes 25 to the photosensitive drum 21 one after another, the toner images on the photosensitive body are transferred onto the sheet 224, and the toner image is fixed to the sheet by the fixing rolls 210.

If, in this condition, the sheet delivery switching pawl 211 is set for the sheet discharging tray 212, the sheet 224, on the one side of which the image of the original has been copied, is delivered to the tray 212.

If, in the same condition, the pawl 211 is set for the sheet reversing chute 213 and the motor 230 is driven to operate the electromagnetic clutches 229 and 235, the sheet 224, on the one side of which the image of an original has been copied, is delivered into the chute 213. Thus, the sheets 224 are held (or stored) by the belt 219, which is wound on the endless belt 218, while being pushed against the belt 219 by the belt clamping rolls 215.

In the case of the two-sided copying operation, The course switching pawl 221 is operated so that the chute 213 communicates with the chute 222, the electromagnetic clutch 229 is deenergized while the electromagnetic clutch 233 is energized, the sheet reversing rolls 214 are turned in the opposite direction and the conveying rolls 233 are rotated. In this operation, the belt 219 is rewound from the belt supporting rolls 216 and 217 so as to be wound on the shaft 220, while the sheets 224 held by the belt 219 laid on the belt supporting rolls 216 and 217 are separated from the belt 219 by the separating pawl 225. The sheet 224 thus separated are moved upwardly in the chute 213 and are then delivered through the chutes 222 and 25 to the drum-shaped photo-sensitive body 21. During this operation, the sheet, on one side of which an original has already been copied is reversed (turned over) before it reaches the photosensitive body. Thus, at the photosensitive body, the toner image is transferred onto the side of the sheet on which no image is yet copied, and the image is fixed by the fixing rolls 210. Thus, the two-sided copying operation is accomplished.

In the device shown in FIGS. 4 through 6, one-side-copied sheets 224 are held by the belt 219 on the belt supporting rolls 216 and 217 one by one. Therefore, irrespective of the kinds, sizes and curl of these sheets, the sheets can easily be supplied to the copying machine after being reversed.

The distance between the belt supporting rolls 216 and 217 can be changed as desired; that is, the linear parts of the belt 219 wound on the rolls 216 and 217 can be made sufficiently long, so that the sheets 224 are prevented from curling as much as possible.

If only one belt supporting roll is employed and a belt 219 having a predetermined length is spirally wound on the roll, the outside diameter thereof is increased, so that the inertial moment is increased. Therefore, in the two-sided copying operation, owing to the rotational inertia which occurs in rewinding the roll, the roll rewinding peripheral speed is made higher than the belt rewinding speed, so that the brake torque of the slip clutch preventing the belt on the roll from slacking in increased, with the result that great power is required for rewinding. However, in the example described above, the belt 219 having a predetermined length is wound on two belt supporting rolls 216 and 217, and therefore the inertial moment is small, the brake torque of the slip clutch 227 is reduced, and the rewinding power can be small.

The belt 219 is laid over the two belt supporting rolls 216 and 217; that is, the belt 219 is wound flat. Accordingly, the belt can be arranged compactly in a copying machine, which contributes to miniaturization of the copying machine.

As the layers of the belt 219 laid over the rolls 216 and 217 are less variable in thickness, the fulcrum of the separating pawl 225 can be positioned near the separating point, which contributes to an effective utilization of space.

Figure 7:
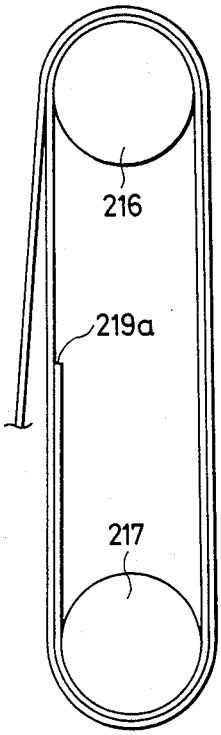
FIG. 7 is an enlarged side view showing the essential parts of another example of the device of the invention.

In the device shown in FIGS. 4 through 6, one end of the belt 219 is fixedly secured to the endless belt 218 on the belt supporting rolls 216 and 217. However, the following method may be employed. As shown in FIG. 7, a belt 219 may be wound on the belt supporting rolls 216 and 217, with the end 219*a* of the belt fixedly secured to the body of the belt.

According to the invention, it is unnecessary to provide a mechanism for delivering sheets one after another, or a one-side-copied sheet receiving tray. Therefore, the device of the invention is compact, simple in construction, and low in manufacturing cost.

The above-described example of the device is described as being applied to the copying machine; however, it goes without saying that the device is applicable to a system such as a facsimile system.

In the above-described example, the width of the "Mylar" film 12 or the belt 219 is substantially equal to the width of a sheet. However, the same effect can be obtained by employing a method in which the "Mylar" film or the belt is cut longitudinally into a plurality of parts, and the parts thus prepared are arranged at predetermined intervals in the widthwise direction.

As is apparent from the above description, in the device for supplying sheets to an apparatus such as a copying machine or facsimile for two-sided copying in a switching mode; according to the invention, a branched passage is provided on the sheet discharge side of the apparatus, sheet delivery switching means is provided in the branched passage, a sheet winding means is arranged in one sheet deliverying passage, means for rewinding the sheet winding means is provided, and reversing sheet conveying means for conveying a sheet rewound from the winding means to the sheet supply side of the apparatus is provided. Therefore, when the sheet delivery switching means is operated so as to communicate with one sheet delivery passage, the sheet winding means is driven in the winding direction and the apparatus is operated, and sheets, on the first sides of which recording has taken place are passed through the sheet delivery switching means one by one so as to be held between belt layers formed by winding the sheet winding means. After the original has been recorded on the first sides of the sheets, the sheet delivery switching means is operated in the opposite direction and the sheet reversing conveying means is operated, the sheet winding means is rewound so that the one-side-copied sheets held between the belt layers are delivered into the reversing sheet conveying means. Thus, the sheets are delivered to the apparatus while being turned over, and an original is recorded on the other sides of the sheets by the apparatus.

Thus, pictures are recorded on both sides of each of the sheets according to the invention.

In the device of the invention, the sheets are held between "Mylar" belt or film layers wound spirally on a scroll, or between belt layers of a rolled belt. Therefore, the sheets can be held by the film or belt, irrespective of the quality of paper, the size and curl thereof.

It is thus unnecessary to provide a one-side-copied sheet receiving tray or a mechanism for delivering sheets one after another, as described above. Therefore, the device of the invention can be made small in size, simple in construction and low in manufacturing cost.

What is claimed is:

1. A sheet supplying device for two-sided copying, comprising:

a branched passage provided on the sheet discharge side of a reproduction apparatus;

sheet delivery switching means provided in said branched passage;

sheet winding belt means in one sheet delivery passage;

means for unwinding said sheet winding belt means; and sheet conveying means for conveying a sheet unwound from said winding belt to the sheet supply side of said apparatus in a manner such that a non-recorded side of said sheet is presented for recording.

2. A device as claimed in claim 1, wherein said branched passage leads in one direction to said sheet winding belt means, and in the other direction to a sheet discharge tray.

3. A device as claimed in claim 1, said switching means including means movable within said branched passage to a position for diverting sheets toward said sheet winding belt means.

4. A device as claimed in claim 1, said sheet winding belt means including a pair of spools, belt means having ends respectively attached to said spools, and means for guiding sheets toward a winding spool such that sheets are wounded on said winding spool between adjacent windings of said belt means.

5. A device as claimed in claim 4, said guiding means comprising a movable guide chute, pinch roller means and guiding finger means.

6. A device as claimed in claim 5, said guiding finger means further comprising sheet stripping means for removing sheets from said winding spool when said winding spool is unwound.

7. A device as claimed in claim 5, said sheet conveying means comprising an elongated sheet transport path from said winding spool to said sheet supply side of said apparatus, said movable guide chute being movable to a position for guiding sheets from said winding spool to said transport path.

8. A sheet supplying device for two-sided copying, comprising:

a branched passage provided on the sheet discharge side of a reproduction apparatus;

sheet delivery switching means provided in said branched passage;

sheet winding belt means provided in one sheet delivery passage; rewinding means for unwinding said sheet winding belt means;

sheet conveying means for conveying a sheet unwound from said winding belt, and for delivering a sheet to a sheet supply side of the apparatus for recording on a second side thereof; and said sheet winding belt means being wound or unwound in the form of belt layers, said belt layers being supported by a plurality of rolls.

9. A device as claimed in claim 8, wherein said branched passage leads in one direction to said sheet winding belt means, and in the other direction to a sheet discharge tray.

10. A device as claimed in claim 8, said switching means including means movable within said branched passage to a position for diverting sheets toward said sheet winding belt means.

11. A device as claimed in claim 8, said sheet winding belt means comprising a pair of rolls supporting an endless belt, a second belt having one end attached to said endless belt, and a spool connected to the other end of said second belt.

12. A device as claimed in claim 11, further including a driving motor for one of said pair of rolls and said spool, and slip clutch means between said motor and said one roll and said spool, respectively.

13. A device as claimed in claim 11, said sheet winding belt means further including pinch roller means and guiding finger means for guiding sheets toward said pair of rolls, such that sheets are wound on said endless belt between adjacent windings of said second belt thereon.

14. A device as claimed in claim 13, said guiding finger means further comprising sheet stripping means for removing sheets from said second belt when the latter is unwound from said endless belt.

15. A device as claimed in claim 11, said endless belt comprising a loop portion of said second belt.

16. A device as claimed in claim 14, said sheet conveying means comprising an elongated sheet transport path from said pair of rolls and said endless belt to said sheet supply side of the apparatus, and second switching means for directing sheets toward said sheet supply side and away from said sheet delivery switching means.

* * * * *